US008973187B2

(12) United States Patent
Hornbach

(10) Patent No.: US 8,973,187 B2
(45) Date of Patent: Mar. 10, 2015

(54) BED FRAME ASSEMBLY WITH A LIFT SYSTEM HAVING A TRANSLATABLE CARRIAGE

(71) Applicant: Hill-Rom Services, Inc., Batesville, IN (US)

(72) Inventor: David W. Hornbach, Brookville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 14/071,048

(22) Filed: Nov. 4, 2013

(65) Prior Publication Data

US 2014/0123389 A1 May 8, 2014

Related U.S. Application Data

(63) Continuation-in-part of application No. 12/967,440, filed on Dec. 14, 2010, now Pat. No. 8,607,384.

(60) Provisional application No. 61/369,337, filed on Jul. 30, 2010.

(51) Int. Cl.

| | |
|---|---|
| ***A47B 7/00*** | (2006.01) |
| ***A61G 7/012*** | (2006.01) |
| ***A61G 7/05*** | (2006.01) |
| *A61G 7/015* | (2006.01) |
| *A61G 7/053* | (2006.01) |
| *A61G 7/16* | (2006.01) |

(52) U.S. Cl.

CPC ..... *A61G 7/012* (2013.01); *A61G 7/0507* (2013.01); *A61G 7/015* (2013.01); *A61G 7/0506* (2013.01); *A61G 7/053* (2013.01); *A61G 7/16* (2013.01); *A61G 2007/0514* (2013.01)

USPC ..... 5/611; 5/600; 5/613

(58) Field of Classification Search

USPC ..... 5/610, 611, 11, 600

See application file for complete search history.

(56) References Cited

U.S. PATENT DOCUMENTS

| | | | | |
|---|---|---|---|---|
| 5,074,000 | A | 12/1991 | Soltani et al. | |
| 6,912,746 | B2 | 7/2005 | Grove | |
| 6,978,500 | B2 | 12/2005 | Osborne et al. | |
| 7,694,367 | B2 | 4/2010 | Zakrzewski | |
| 8,176,584 | B2 | 5/2012 | Hornbach et al. | |
| 2008/0289106 | A1 | 11/2008 | Beyer et al. | |
| 2010/0050343 | A1 * | 3/2010 | Hornbach et al. | 5/611 |
| 2012/0151678 | A1 * | 6/2012 | Richards | 5/613 |

* cited by examiner

*Primary Examiner* — Robert G Santos
*Assistant Examiner* — Richard G Davis
(74) *Attorney, Agent, or Firm* — Barnes & Thornburg LLP

(57) ABSTRACT

A bed frame assembly includes a base frame 32, an elevatable frame 40 and a lift system 80. The lift system includes a carriage 82 longitudinally translatably mounted on the base frame and a lift arm 84 having a crank end 86 and a remote end 88. The crank end of the lift arm is mounted to the carriage at a pivotable joint A for pivoting about a laterally extending crank axis 100. The remote end of the lift arm is connected to the elevatable frame by a lift arm connector 102, which may take various forms. The lift system also includes an actuator 120 mounted on the carriage at a juncture B and connected to the lift arm such that operation of the actuator rotates the lift arm about the crank axis. The lift system also includes a part span connector 130 pivotably connected to the lift arm at a joint D and pivotably connected to the base frame at a joint C. In one embodiment the lift arm connector is a single link 132. In another embodiment the lift arm connector comprises multiple links such as first and second links 144, 146.

16 Claims, 20 Drawing Sheets

BED FRAME ASSEMBLY WITH A LIFT SYSTEM HAVING A TRANSLATABLE CARRIAGE

RELATED APPLICATIONS

This application is a continuation-in-part application of application Ser. No. 12/967,440 filed Dec. 14, 2010 which claims priority to provisional application no. 61/369,337 filed Jul. 30, 2010, each of which is incorporated by reference herein in their entirety.

TECHNICAL FIELD

The subject matter described herein relates to beds having a base frame and an elevatable frame and particularly to the lift system used to govern the vertical elevation of the elevatable frame relative to the base frame.

BACKGROUND

Beds used in hospitals, other health care facilities and home care settings may have a base frame and an elevatable frame. Such beds also include a lift mechanism for adjusting the height of the elevatable frame relative to the base frame between a maximum elevation and a minimum elevation. It is desirable for the lift mechanism to be compact in order to make efficient use of the limited space between the base frame and the elevatable frame. Compactness may also assist the bed designer in achieving a sufficiently low minimum elevation of the elevatable frame. Compactness and the architecture or layout of the lift system may also provide space that bulky interframe components can occupy, particularly when the vertical separation between the frames is small, thereby further enhancing the ability to achieve a satisfactorily low minimum elevation of the elevatable frame.

SUMMARY

The present disclosure comprises one or more of the features recited in the appended claims and/or the following features which, alone or in any combination, may comprise patentable subject matter:

A bed frame assembly includes a base frame, an elevatable frame, and a lift system. The lift system includes a carriage, longitudinally translatably mounted on the base frame, and a lift arm mounted to the carriage at a pivotable joint A and connected to the elevatable frame by a lift arm connector. The lift system also includes an actuator mounted on the carriage at a juncture B and connected to the lift arm such that operation of the actuator rotates the lift arm about a crank axis. The lift system also includes a part span connector pivotably connected to the lift arm at a joint D and pivotably connected to the base frame at a joint C.

Additional features and advantages of the invention will become apparent to those skilled in the art upon consideration of the following detailed description of illustrated embodiments exemplifying the best mode of carrying out the invention as presently perceived.

BRIEF DESCRIPTION OF THE DRAWINGS

The foregoing and other features of the various embodiments of the bed frame assembly described herein will become more apparent from the following detailed description and the accompanying drawings in which.

DETAILED DESCRIPTION

Figure 1:
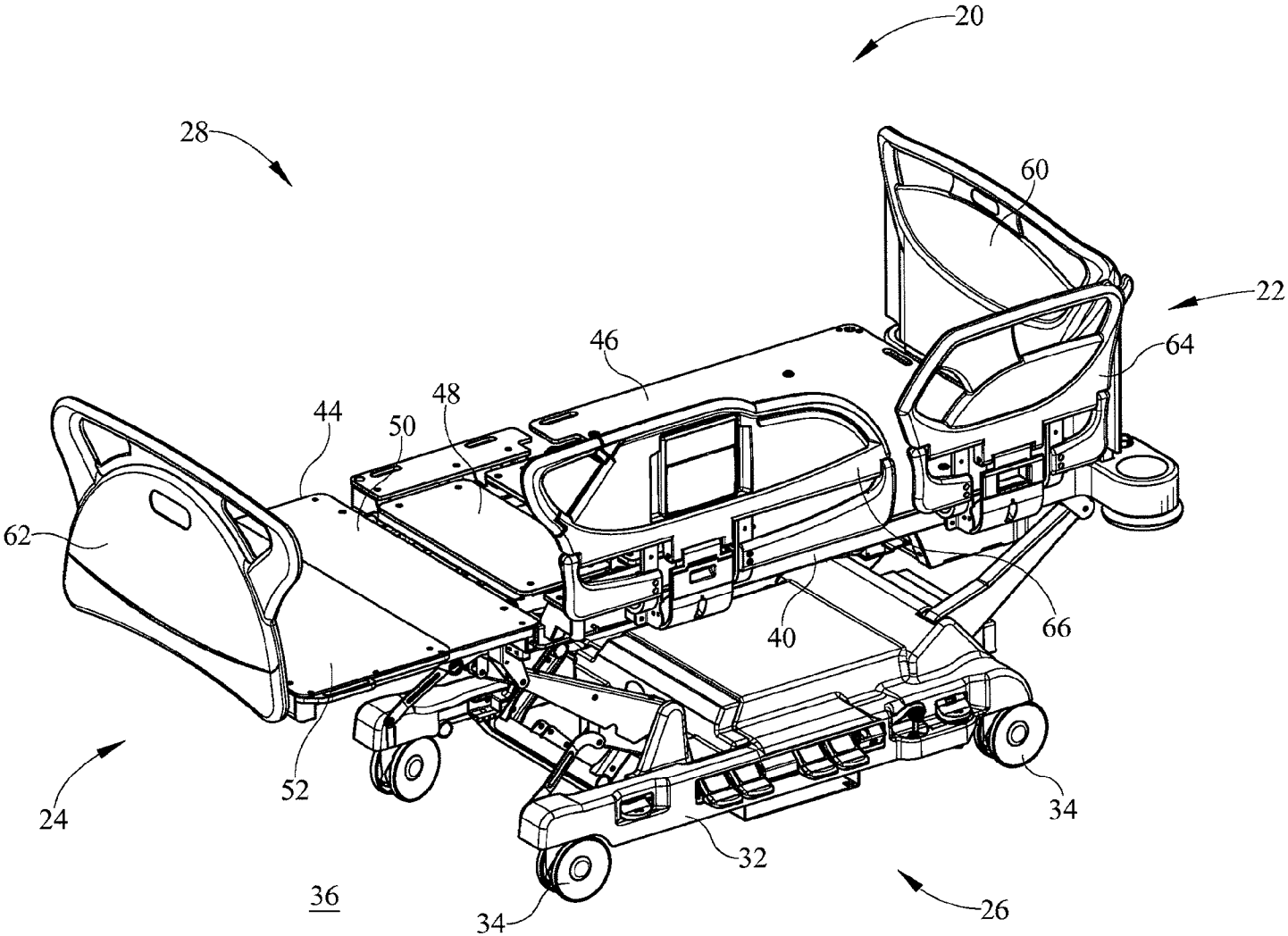
FIG. 1 is a perspective view of a hospital bed having a base frame, an elevatable frame and a segmented deck, the bed being shown in a horizontal configuration.
Figure 2:
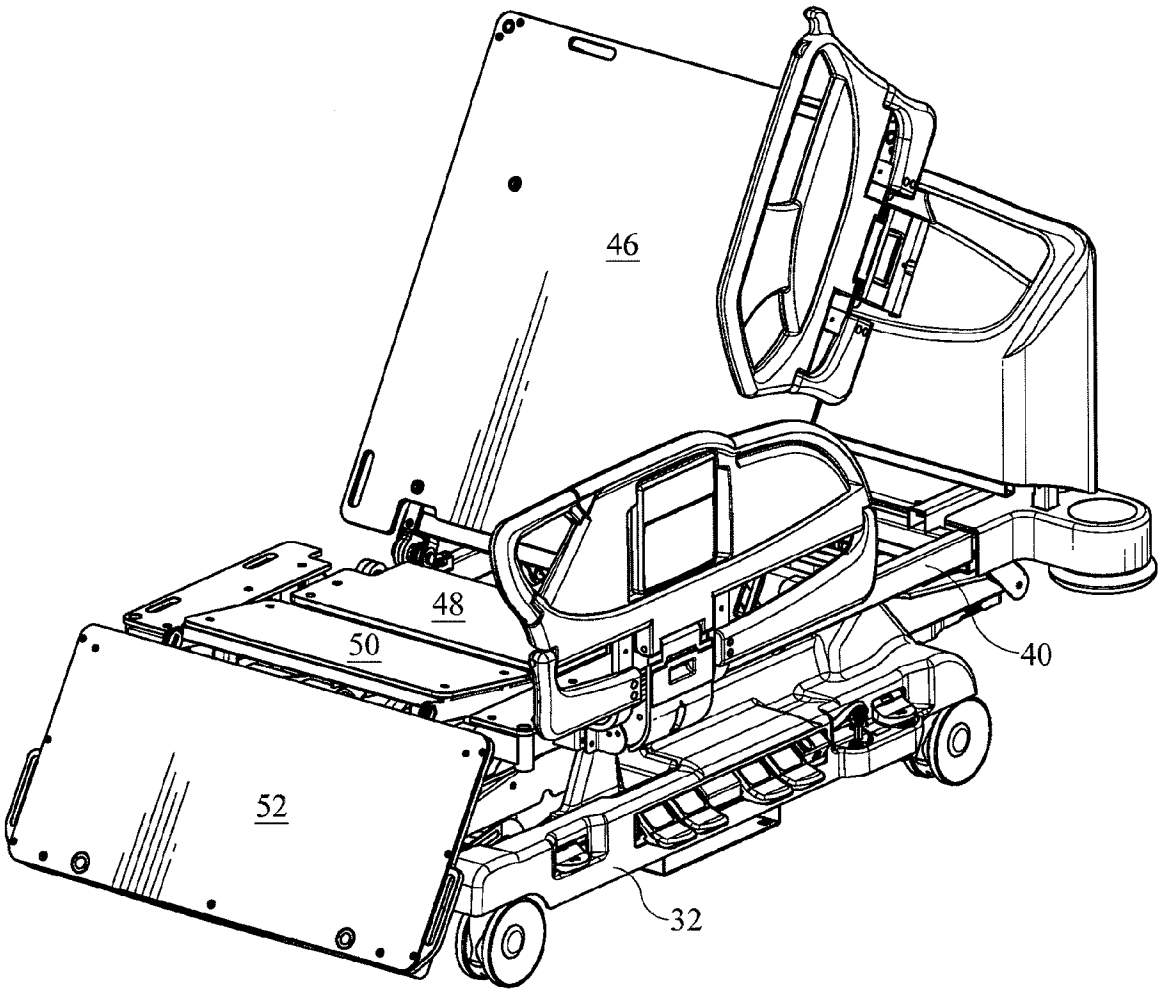
FIG. 2 is a perspective view of the bed of FIG. 1 in a chair configuration.

FIGS. 1 and 2 show a hospital bed 20 having a head end 22, a foot end 24 longitudinally spaced from the head end, a left side 26 and a right side 28 laterally spaced from the left side. The bed includes a bed frame assembly comprising base frame 32 with casters 34 extending to the floor 36, and an elevatable frame 40 supported on the base frame. The elevation of the elevatable frame can be adjusted relative to the base frame. The bed also includes a deck 44 supported on the elevatable frame. The illustrated deck is a segmented deck comprising a torso or upper body section 46, a seat section 48, a thigh section 50 and a calf section 52. The angular orientation of the upper body, thigh and calf sections can be adjusted to achieve a variety of desired bed profiles. A mattress, not shown, rests on the deck. The bed also includes a headboard 60 affixed to the elevatable frame and a footboard 62 affixed to the calf deck section. The bed also includes a left side head end siderail 64, a left side foot end siderail 66, a right side head end siderail, not shown, and a right side foot end siderail, also not shown. As is evident from FIG. 2 the bed can be placed in at least one chair configuration which may or may not be suitable for facilitating occupant ingress or egress.

Figure 3:
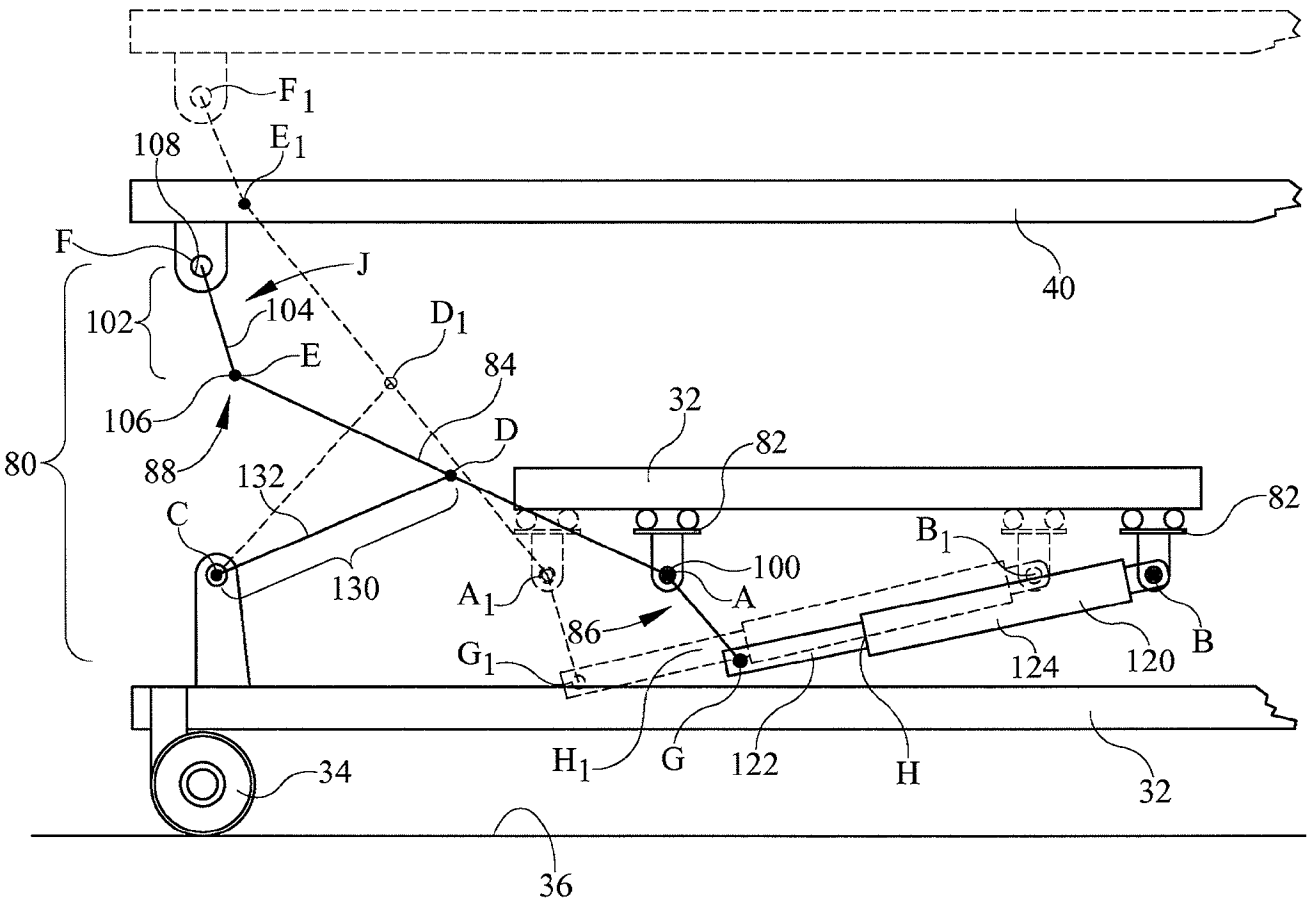
FIG. 3 is a schematic, right side elevation view of a first embodiment of a bed frame assembly described herein with a lift system and the elevatable frame shown in a first position (solid lines) and a second position (broken lines).
Figure 4:
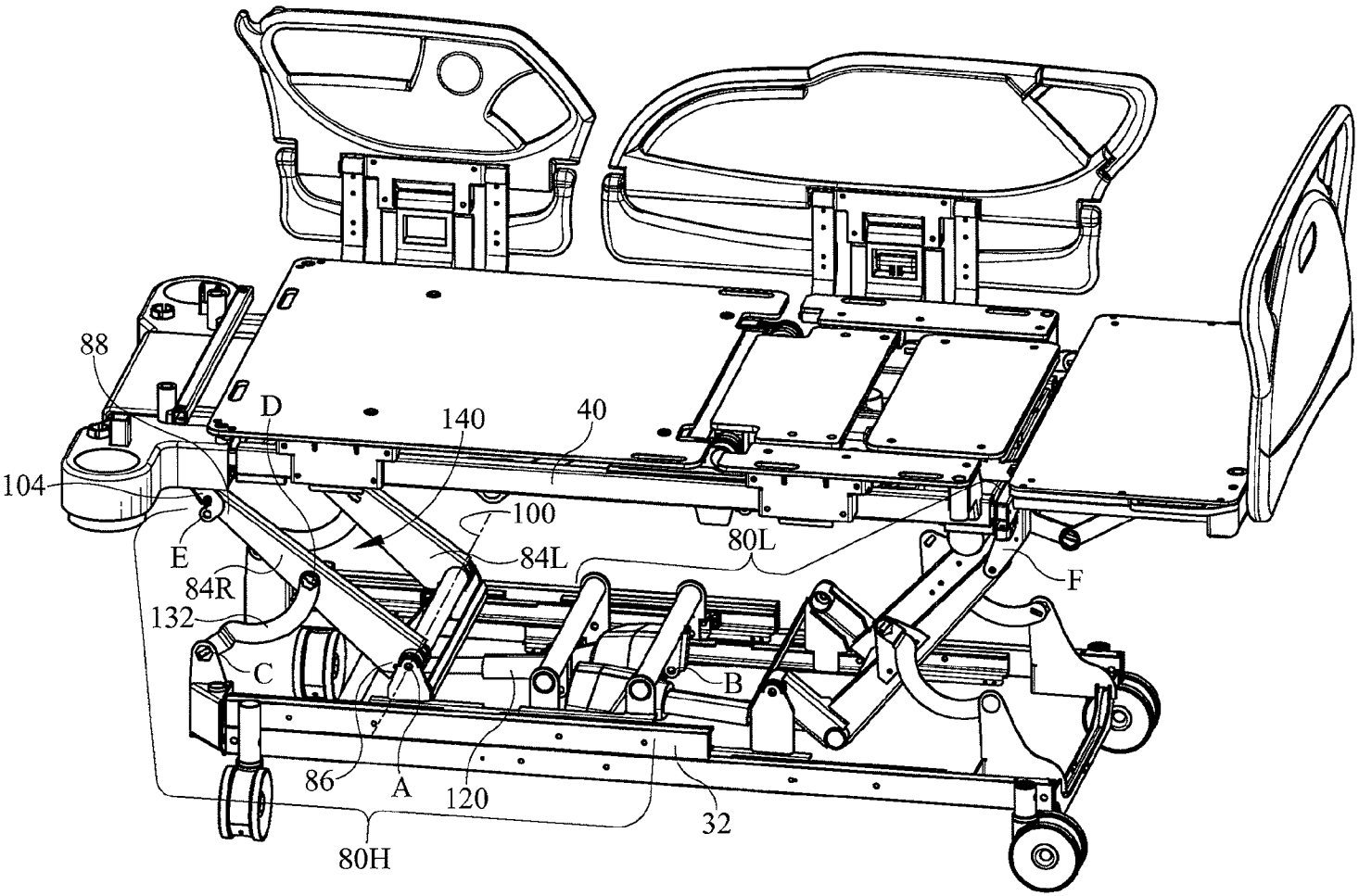
FIG. 4 is a right side perspective view of a prototype of the first embodiment of the bed frame assembly described herein as seen by an observer looking from a location above the bed.
Figure 5:
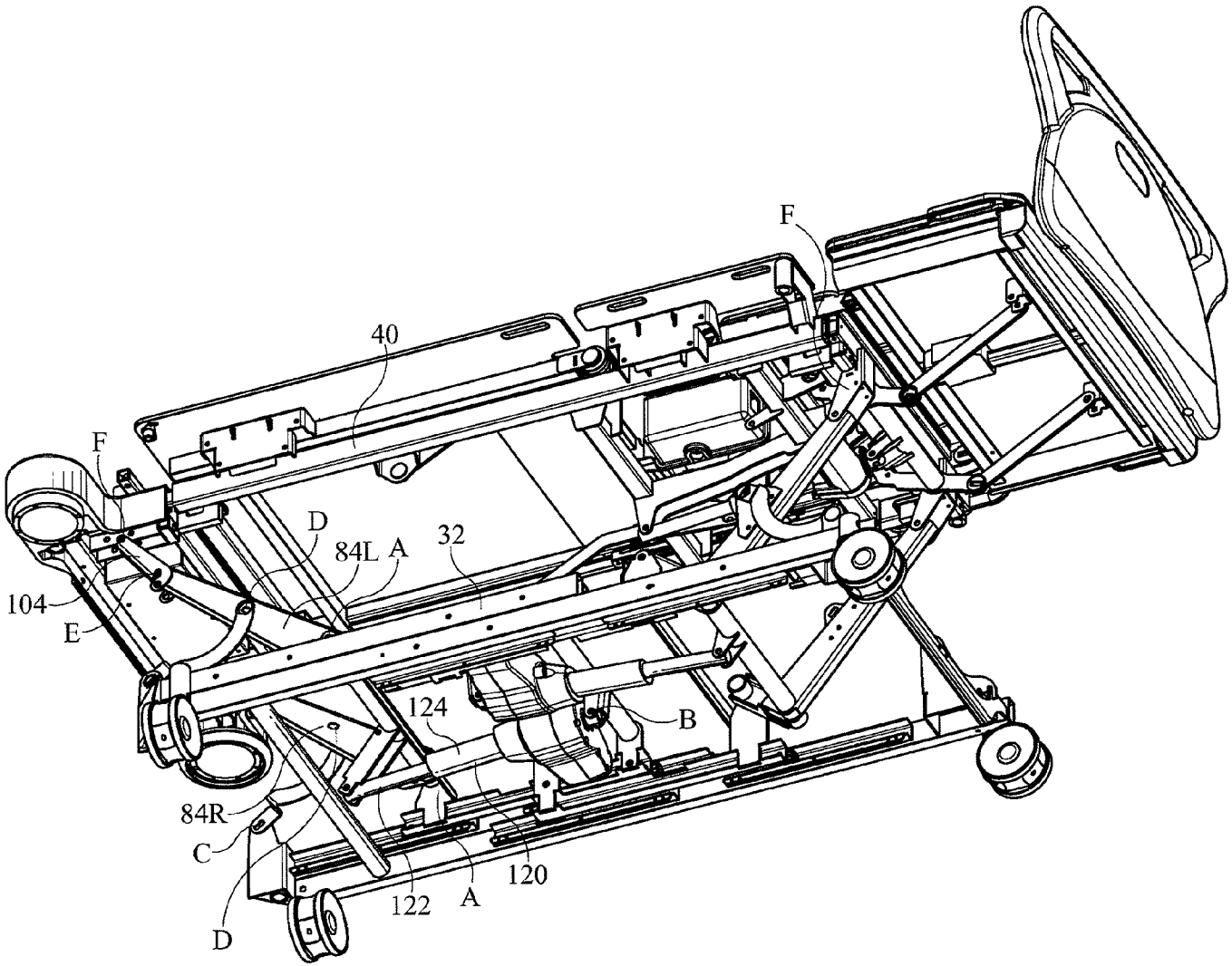
FIG. 5 is a view similar to that of FIG. 4 as seen by an observer looking from a location below the bed.

Referring FIGS. 3-10 and principally to FIGS. 3 and 4, the bed frame assembly also includes a lift system 80 shown in a first position (solid lines of FIG. 3) and a second position (broken lines of FIG. 3). The lift system comprises a carriage 82 longitudinally translatably mounted on the base frame 32, for example by sliders or rollers. The lift system also includes a lift arm 84 having a crank end 86 and a remote end 88. The crank end of the lift arm is mounted to the carriage at a pivotable joint A so that the crank arm is pivotable about a laterally extending crank axis 100. The remote end of the lift arm forms a junction J with a lift arm connector 102 thereby connecting the remote end 88 of the lift arm 84 to the elevatable frame. In the embodiment seen in FIGS. 3-10, the lift arm connector comprises an auxiliary link 104 having a lift arm end 106 and a frame end 108. The lift arm end of auxiliary link 104 is pivotably connected to the remote end of the lift arm at a pivotable joint E; the frame end of the auxiliary link is pivotably connected to the elevatable frame at a pivotable joint F. In a variant of the lift system the connector is a single pivotable joint F. This is seen best in FIG. 6 where frame 40 includes an extension 114 welded by weld 112.

The lift system also includes an actuator 120 mounted on the carriage at a juncture B and connected to the lift arm such that operation of the actuator rotates the lift arm about crank axis 100. In the embodiment of FIGS. 3-10, the actuator is a linear actuator, juncture B between the actuator and the carriage is a pivotable joint B, and the actuator is connected to the lift arm 84 at a pivotable joint G. Joint G is spaced or offset from crank axis 100 to provide a moment arm (the distance from G to A) allowing the actuator to easily rotate the lift arm as actuator piston 122 extends further out of or retracts into actuator housing 124.

The lift system also includes a part span connector 130. In the embodiment of FIGS. 3-10 part span connector 130 is a single link 132 pivotably connected to the lift arm at a joint D and pivotably connected to the base frame at a joint C, which is at substantially the same elevation relative to the floor as joint A. Joint D is separated from junction J (as represented by joint E of FIG. 3 or joint F of FIG. 6) by a distance DJ, joints A and D are separated from each other by a distance AD, and joints C and D are separated from each other by a distance CD. Joints A and D and junction J (as represented by joint E of FIG. 3 or joint F of FIG. 6) lie on a straight line. The distances DJ, AD and CD are substantially equal to each other.

Figure 6:
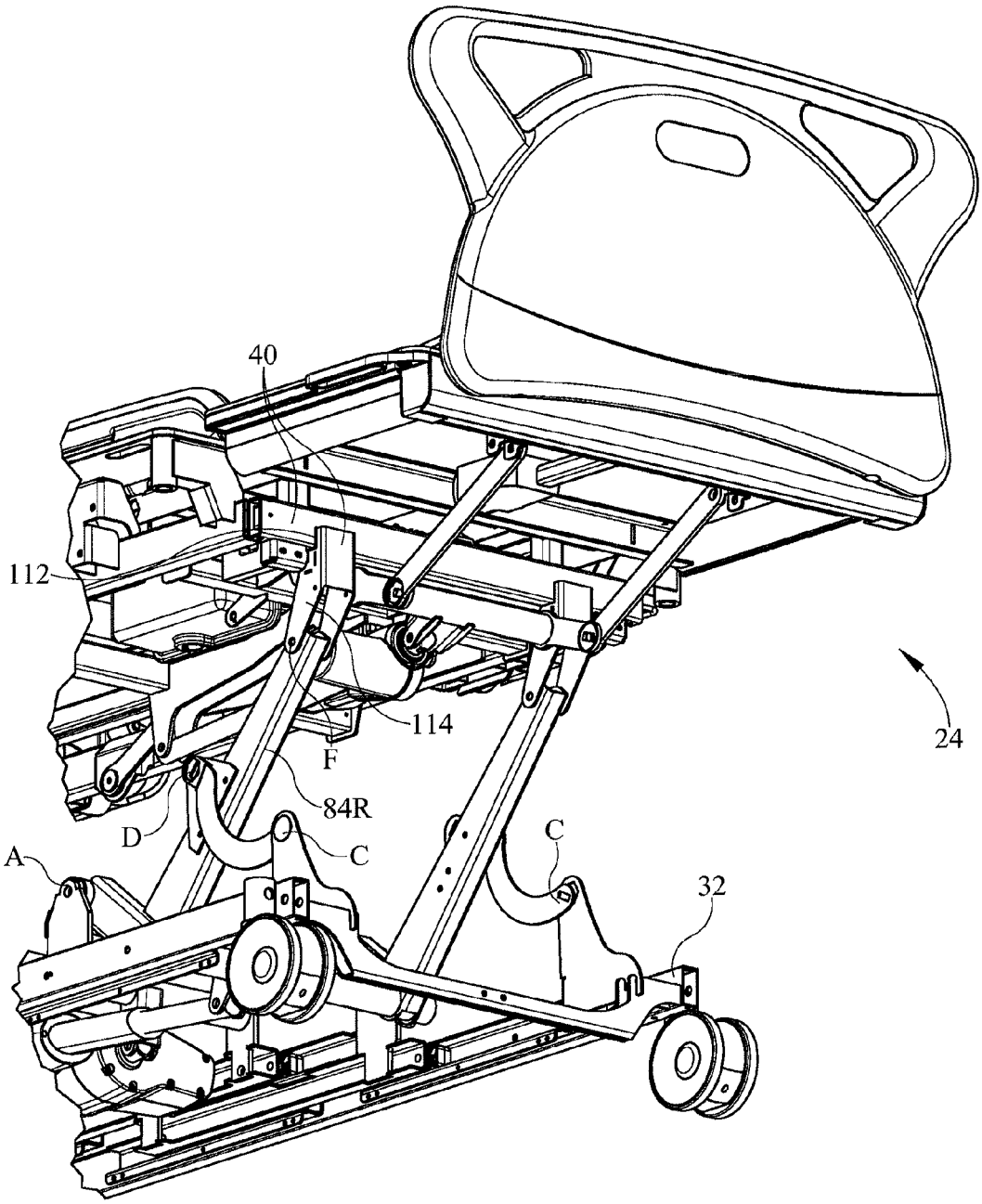
FIG. 6 is a close-up view of the bed frame assembly seen in FIGS. 4-5 showing part of a foot end lift system including a remote end of a foot end lift arm and a lift arm connector in the form of a pivotable joint.

A commercially practical version of the bed frame assembly includes a head end lift system 80H and a foot end lift system 80L (as seen in FIG. 4) with the head end lift system employing a lift arm connector in the form of auxiliary link 104 whose lift arm end is pivotably connected to the remote end of the lift arm at a pivotable joint E and whose frame end is pivotably connected to the elevatable frame at a pivotable joint F (FIG. 5), and with the foot end lift system employing a lift arm connector in the form of a single pivotable joint F (FIG. 6). Alternatively, the lift system with the auxiliary link could be used at the foot end of the frame and the lift system with the single-joint could be used at the head end. In yet another alternative, both lift systems could employ the lift arm connector having the auxiliary link.

In use, operation of actuators 120 changes the vertical separation of the elevatable frame relative to the base frame so that the elevatable frame can be elevated to a fully raised state or elevation, lowered to a fully lowered state or elevation, or positioned at a selected elevation between the fully raised and fully lowered elevations. For example, for the initial position shown in FIG. 3 (solid lines) as the head end actuator piston extends out of its housing, the head end lift arm 84 rotates clockwise about its axis 100 at joint A. Head end link 132 constrains the position of head end joint D relative to head end joint C, thereby causing the head end carriage 82 to translate longitudinally in the direction of joint C with the result that joint E moves substantially perpendicularly relative to base frame 32. For some initial positions other than the one shown in FIG. 3, (e.g. if link 132 is initially oriented at an angle below the horizontal) carriage 82 will initially move away from joint C and then later in the direction of joint C. The foot end lift system operates similarly but is oriented so that its lift arm rotates counterclockwise (when viewed from the same side of the bed) thereby causing its carriage 82 to translate longitudinally in the direction of its joint C. In other words during an increase in vertical separation the lift system carriages translate longitudinally toward their respective ends of the bed but, depending on the initial position of the linkages, may initially translate away from their respective ends of the bed. During an increase in vertical separation the carriages translate principally away from their respective ends of the bed. As the elevatable frame approaches its fully lowered elevation, the lift system carriages may undergo a small motion toward their respective ends of the bed. FIGS. 4 and 8-10 are a sequence of views showing the elevatable frame of the bed frame assembly at a relatively high elevation, a moderately high elevation, a moderately low elevation and a fully lowered elevation respectively.

Figure 7:
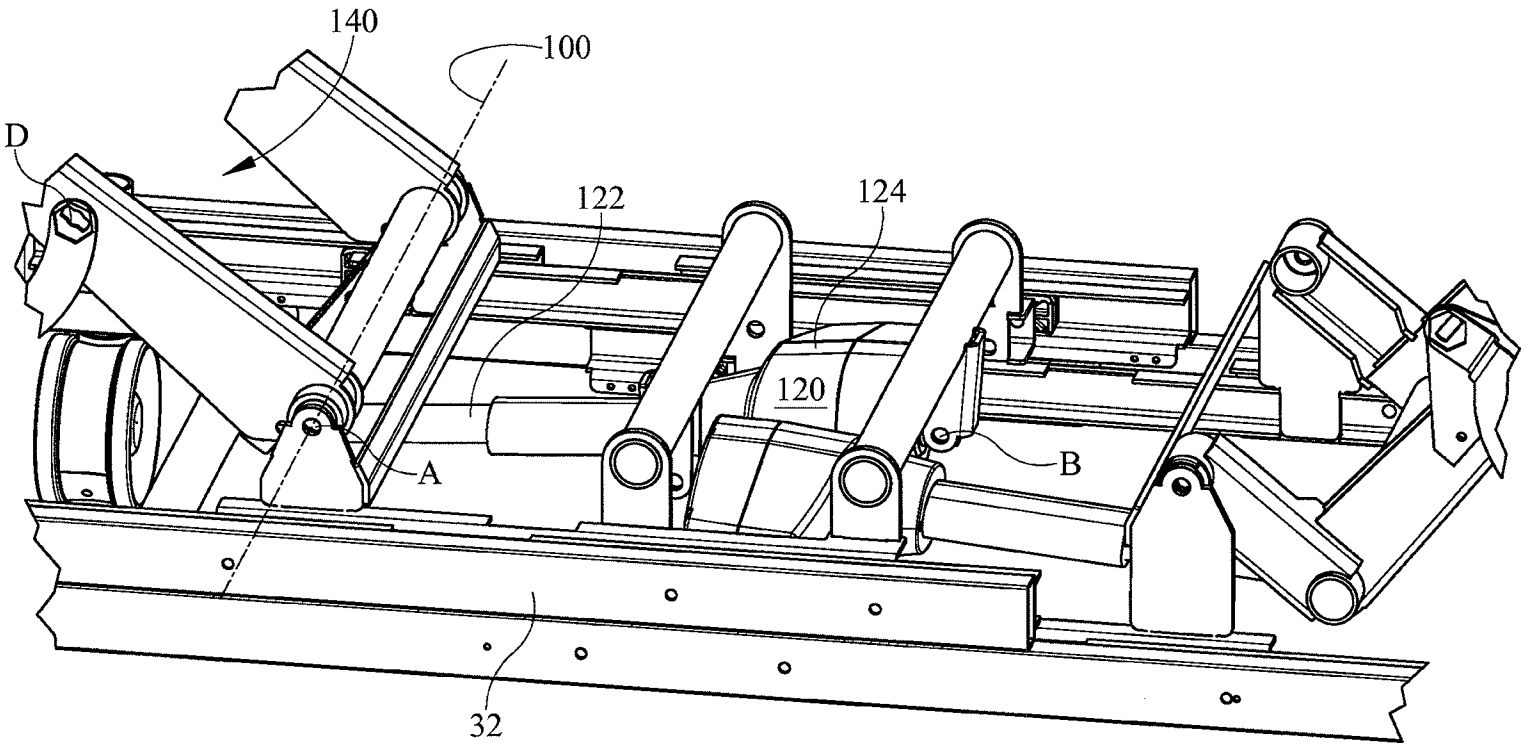
FIG. 7 is a view similar to that of FIG. 4 showing components of the head end lift system in more detail.
Figure 8:
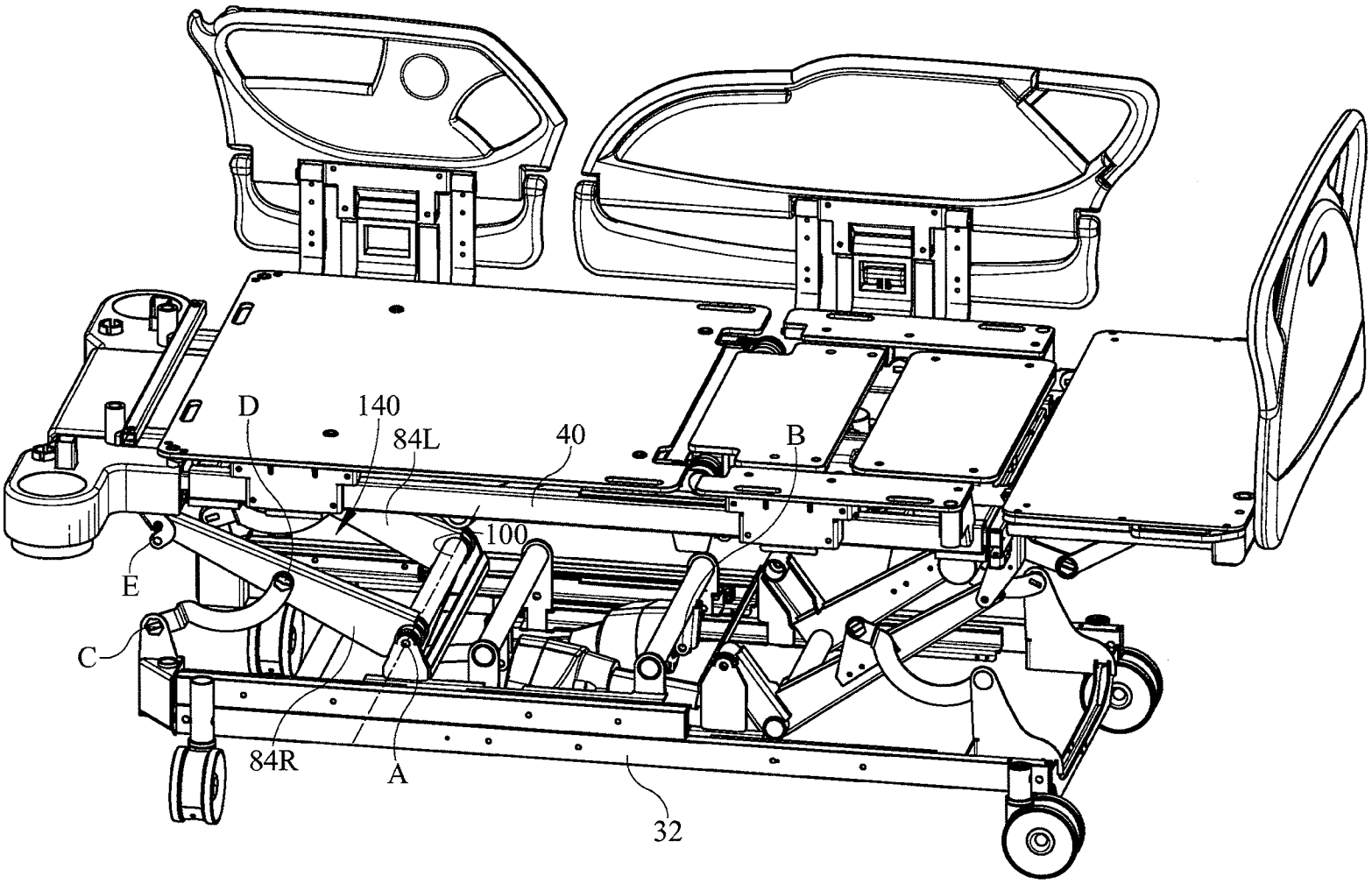
FIGS. 8-10 are a sequence of views similar to that of FIG. 4 showing, in combination with FIG. 4, the elevatable frame of the bed frame assembly at a relatively high elevation, a moderately high elevation, a moderately low elevation and a fully lowered elevation respectively.
Figure 9:
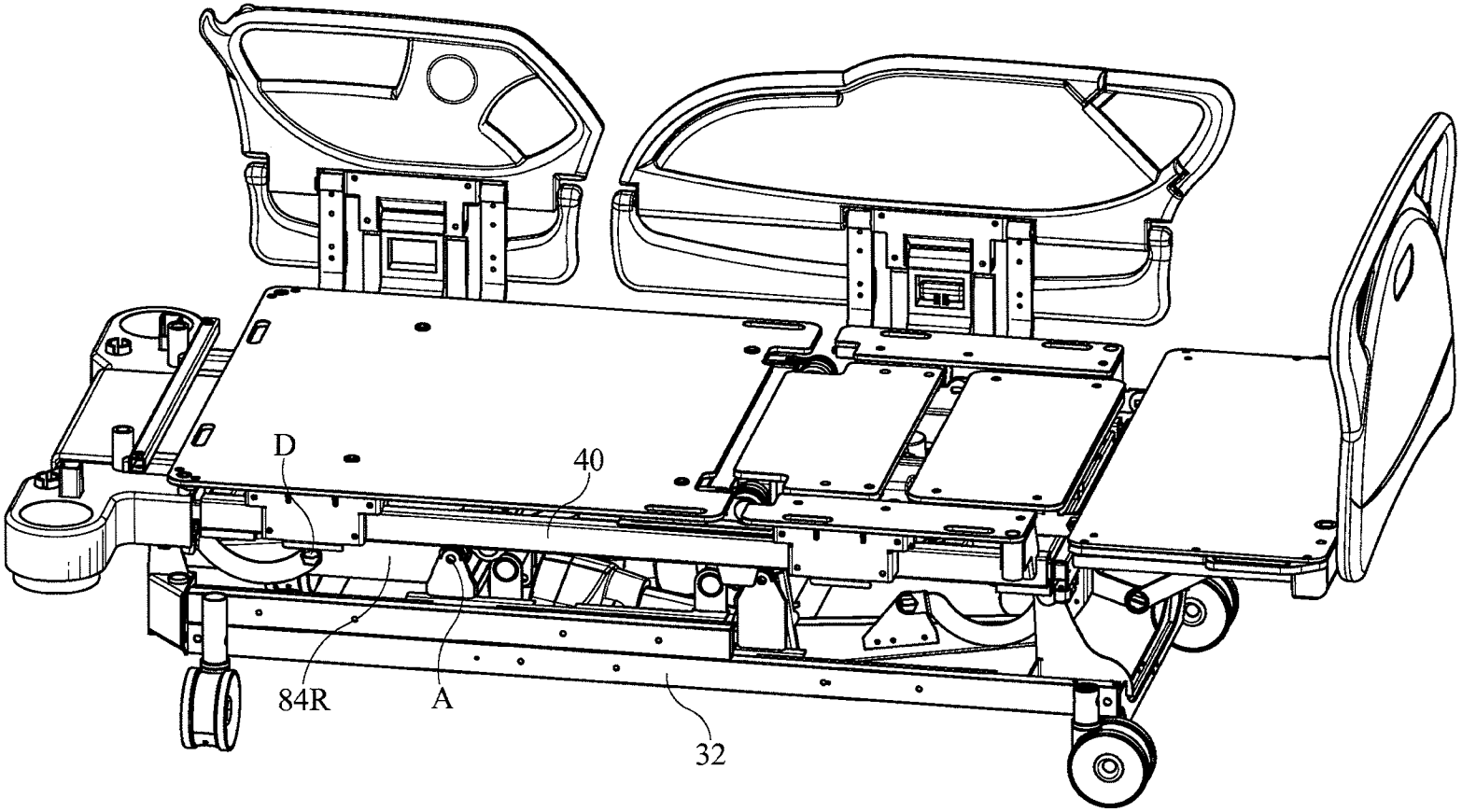
Figure 10:
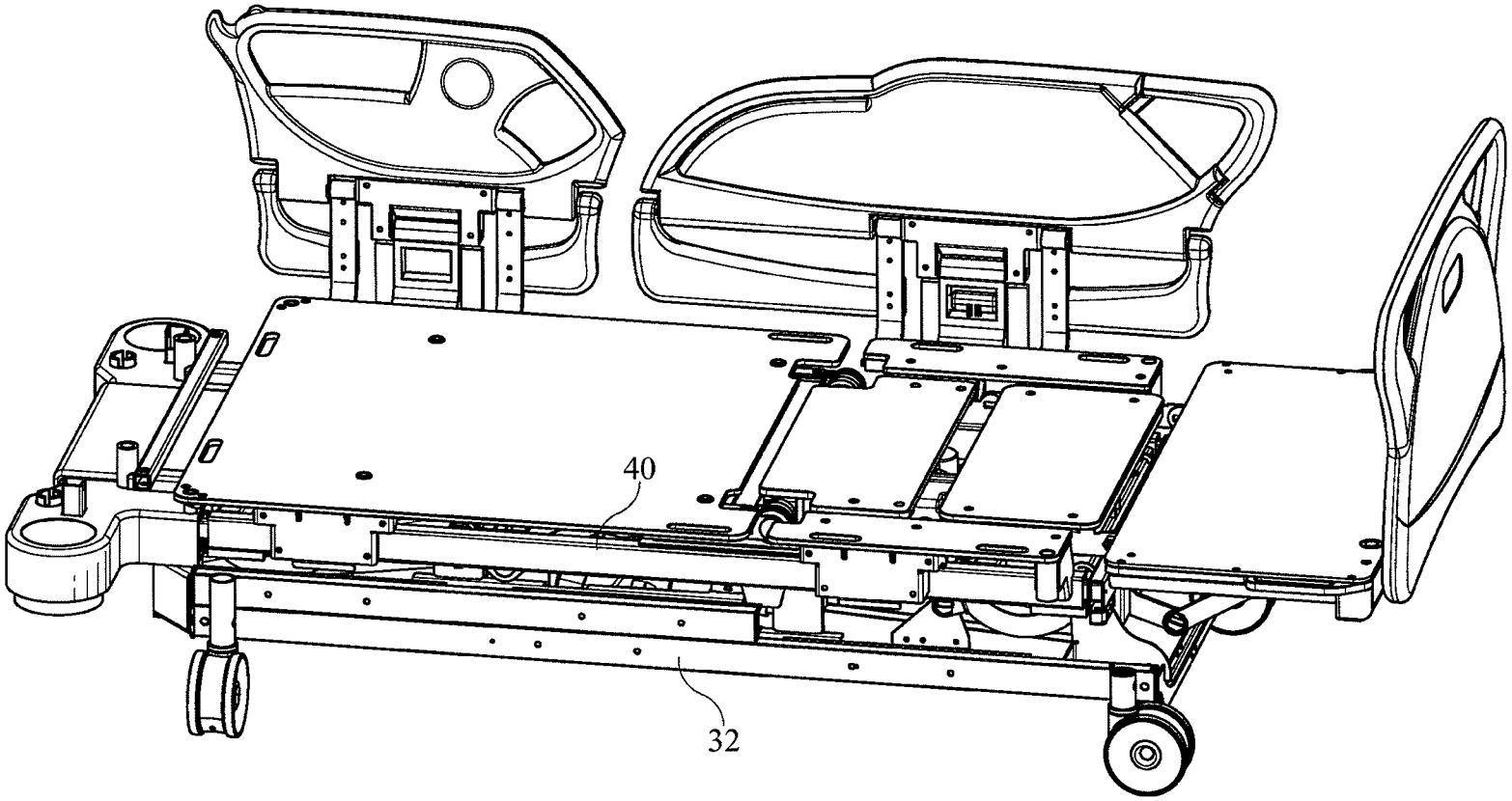

As seen best in FIGS. 4, 7 and 8, the lift system comprises laterally spaced left and right lift arms 84L, 84H. The lift arms and crank axis 100 embrace a void 140 capable of receiving or accommodating the presence of components that vertically approach the base frame as the vertical separation between the elevatable frame and the base frame decreases. Examples of such components include actuators mounted on the underside of the elevatable frame for governing the angular orientation of the deck sections 46, 50, 52. When the elevatable frame is at a relatively high elevation, for example as seen in FIGS. 4, 7 and 8, there is a large volume of space bounded by base frame 32, elevatable frame 40 and the head and food end lift arms 84. This space can be useful for accommodating equipment such as radiological equipment.

The operational demands on actuator 120 can be reduced by ensuring a long moment arm (distance AG) between joints A and G. However doing so can force the system designer to place joint A, and therefore joint C, at a high enough elevation that the fully lowered elevation of the elevatable frame is unsatisfactorily high. A second embodiment of the lift system, shown in FIGS. 11-13 may be effective in overcoming such a limitation.

Figure 11:
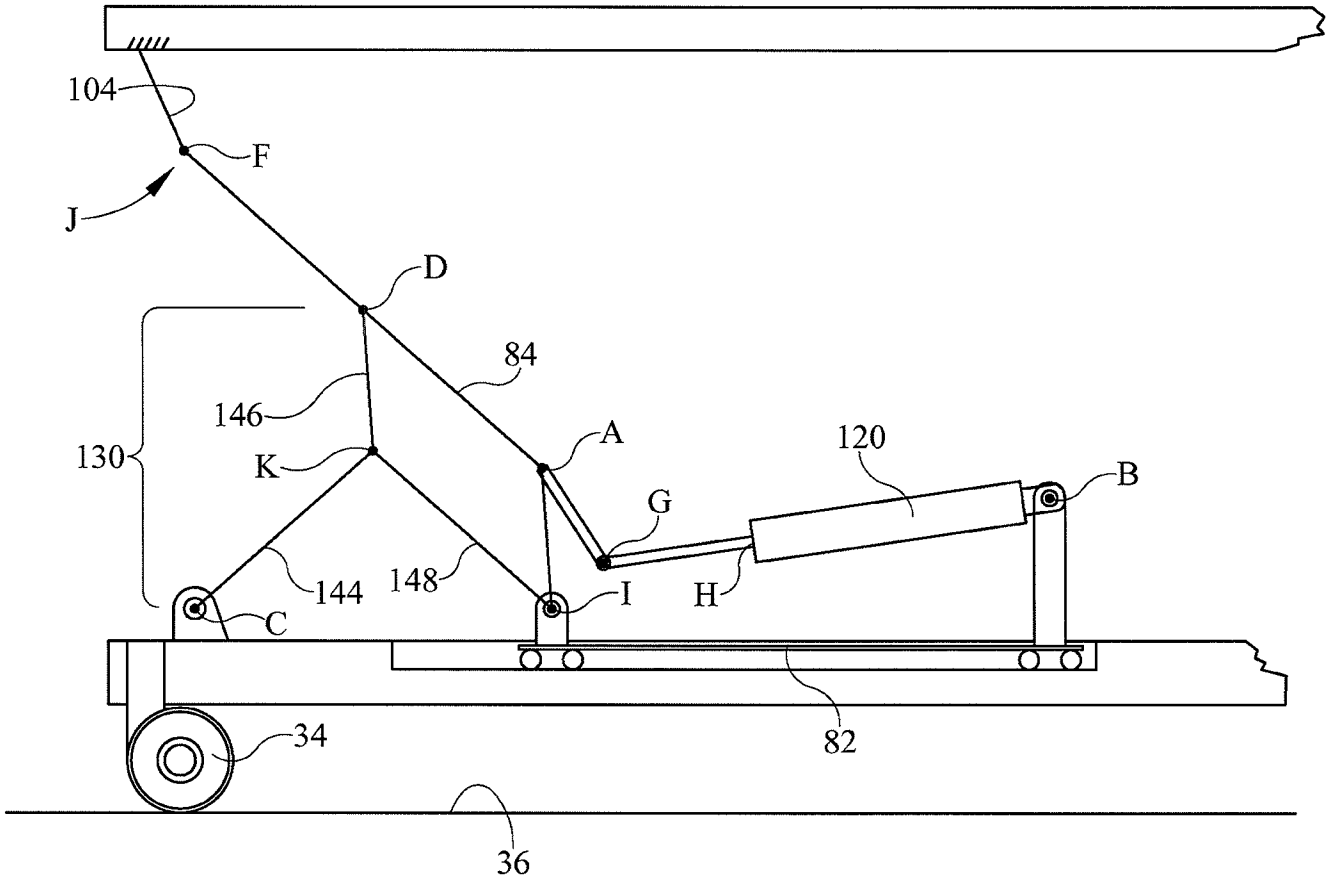
FIG. 11 is a schematic, left side elevation view of a second embodiment of the bed frame assembly described herein showing the foot end lift system and elevatable frame in a first position.
Figure 12:
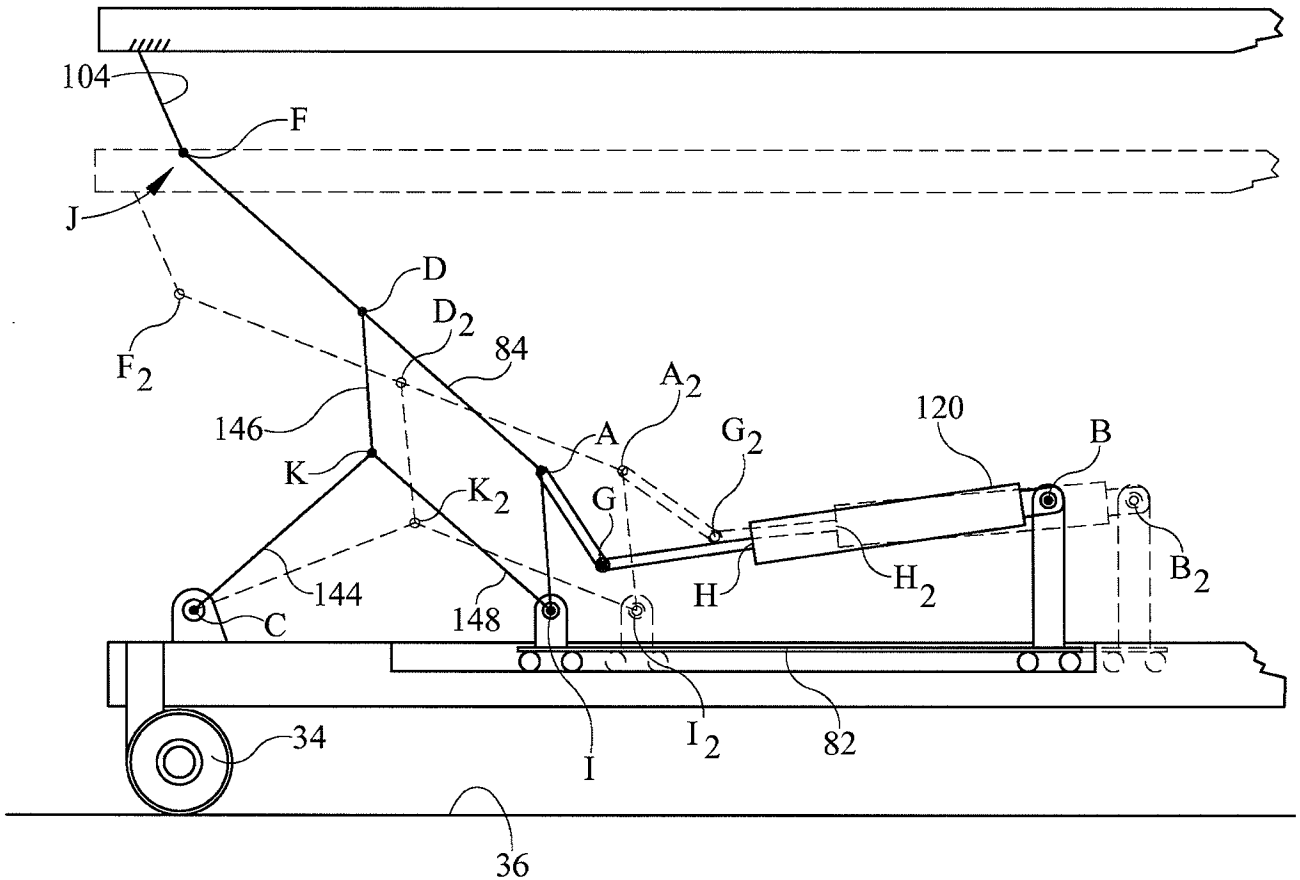
FIGS. 12-13 are views similar to that of FIG. 11 showing the lift system and the elevatable frame in the first position of FIG. 11 (solid lines) in a second position (broken lines of FIG. 12) and in a third position (broken lines of FIG. 13).
Figure 13:
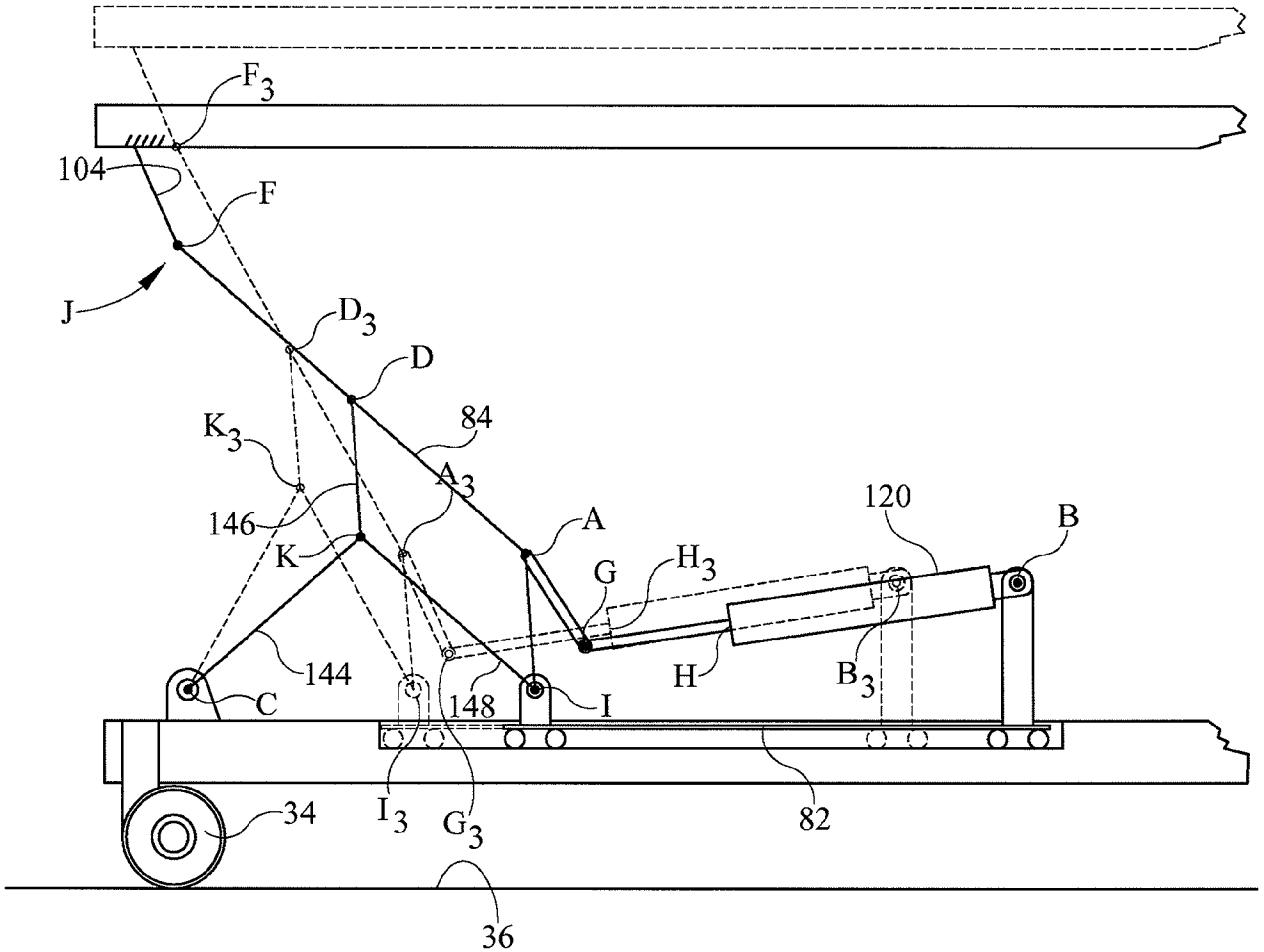
Figure 14:
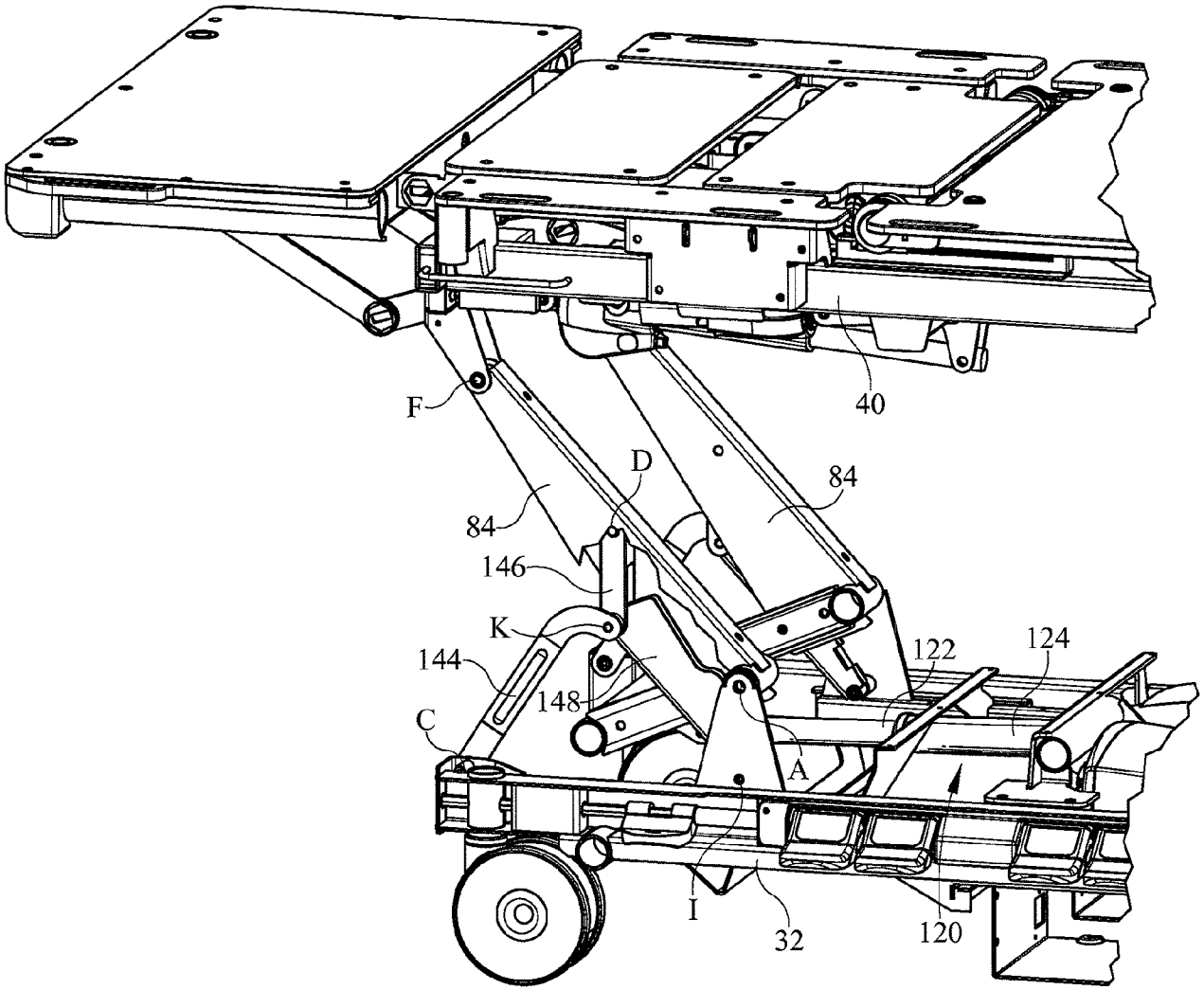
FIG. 14 is a left side perspective view of a prototype of a second embodiment of the bed frame assembly described herein.
Figure 15:
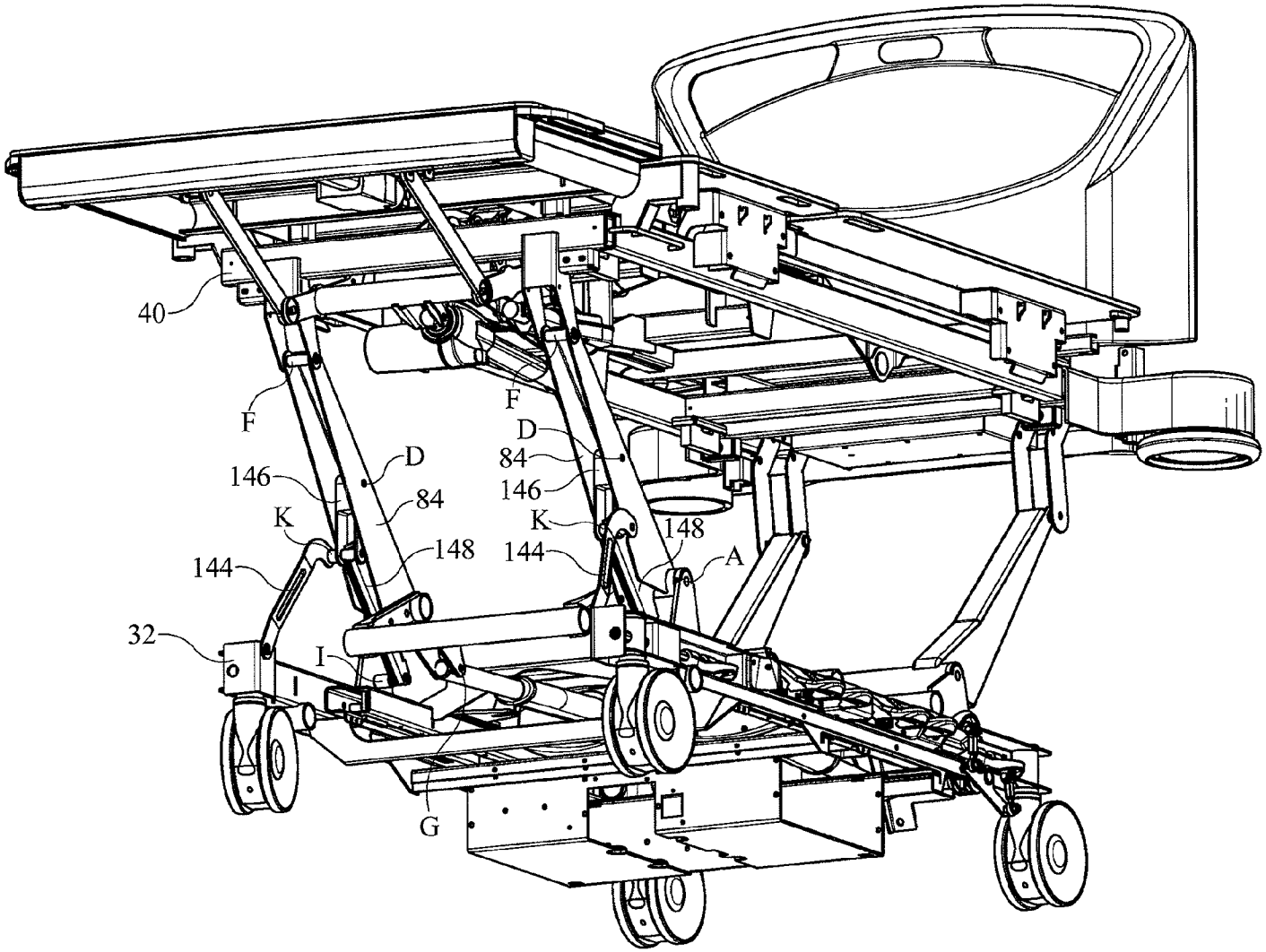
FIG. 15 is a view similar to that of FIG. 14 showing the foot end lift system from a different perspective to render links 146 and 148 more readily visible.

Referring to FIGS. 11-13, the part span connector 130 of the lift assembly of the second embodiment comprises a first link 144 extending from joint C, and a second link 146 extending from joint D. The first and second links are pivotably connected to each other at a common joint K. The lift assembly may also include a third link 148 extending from the common joint K to a joint I that pivotably joins the third link to carriage 82. Joints I and C are at substantially equal elevations. Joints A, D, I and K define corners of a parallelogram. Joint D is separated from junction J (as represented by joint F) by a distance DJ, joints A and D are separated from each other by a distance AD, joints C and K are separated from each other by a distance CK and joints K and I are separated from each other by a distance KI. Distances DJ, AD, CK, and KI are substantially equal to each other.

Figure 20:
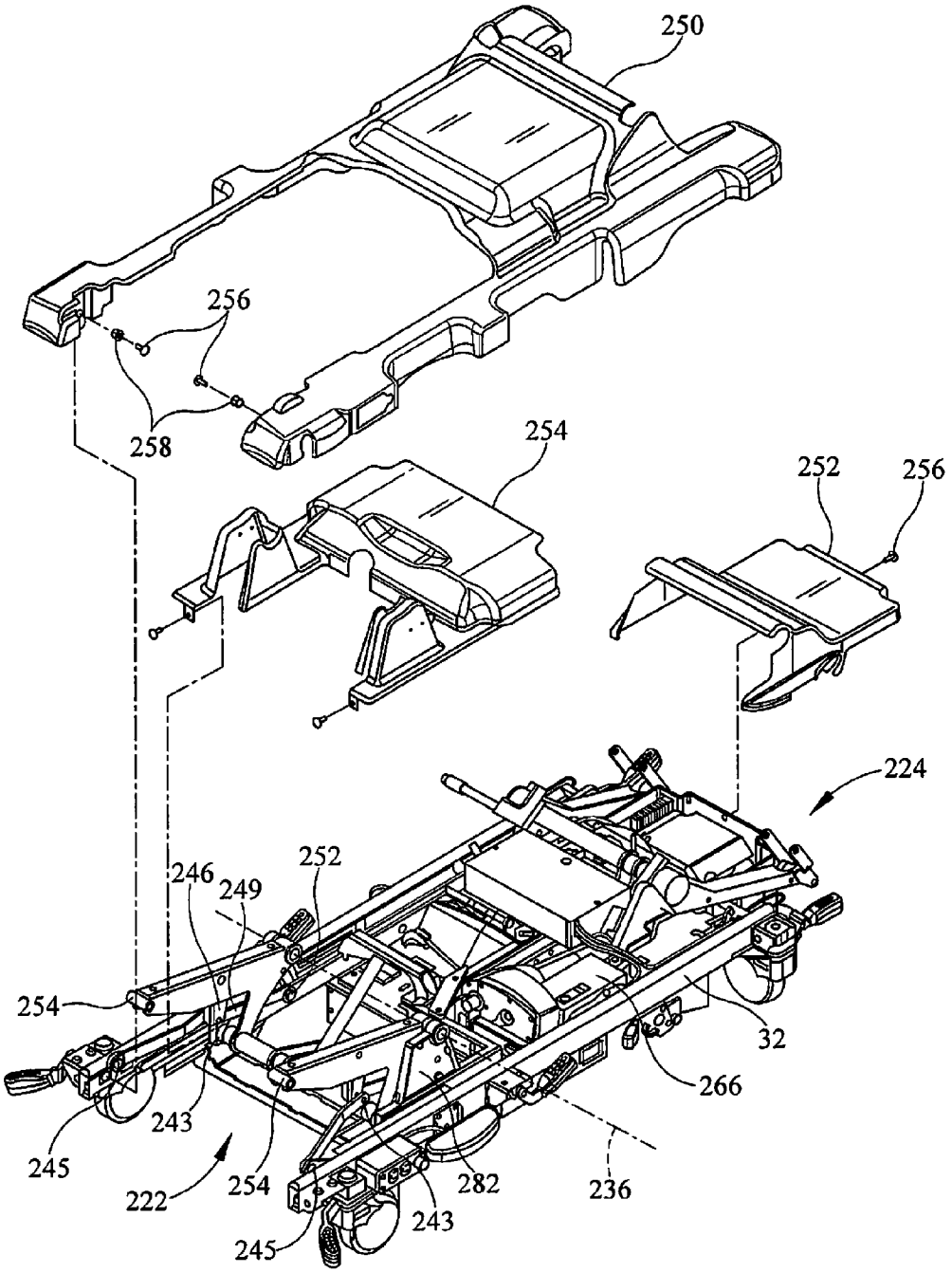
FIG. 20 is a perspective view of a portion of the bed frame assembly of FIGS. 16-19 with portions removed to show structural details not visible in FIGS. 16-19.

The foot end lift mechanism 222 also includes a pair of ground links 244 that are each pivotably coupled to the base frame 32 at pivots 245 on opposite lateral sides with each link 244 pivotably coupled to a swing link 246 at a pivot 243. The swing links 246 are each pivotably coupled to a respective lift arm 284 at a pivot 248. Referring now to FIG. 20, the foot end lift mechanism 222 further includes a pair of link arms 249 each of which is pivotably coupled to the swing links 246 at the pivot 243. The link arms 249 are coupled to the carriage 282 at pivots 252. The link arms 249 and lift arms 284 cooperate as a parallelogram mechanism with the swing link connecting the lift arms 284 and link arms 249 at an upper end and a frame 264 of the carriage 284 connecting the lift arms 284 and link arms 249 at a lower end.

Figure 16:
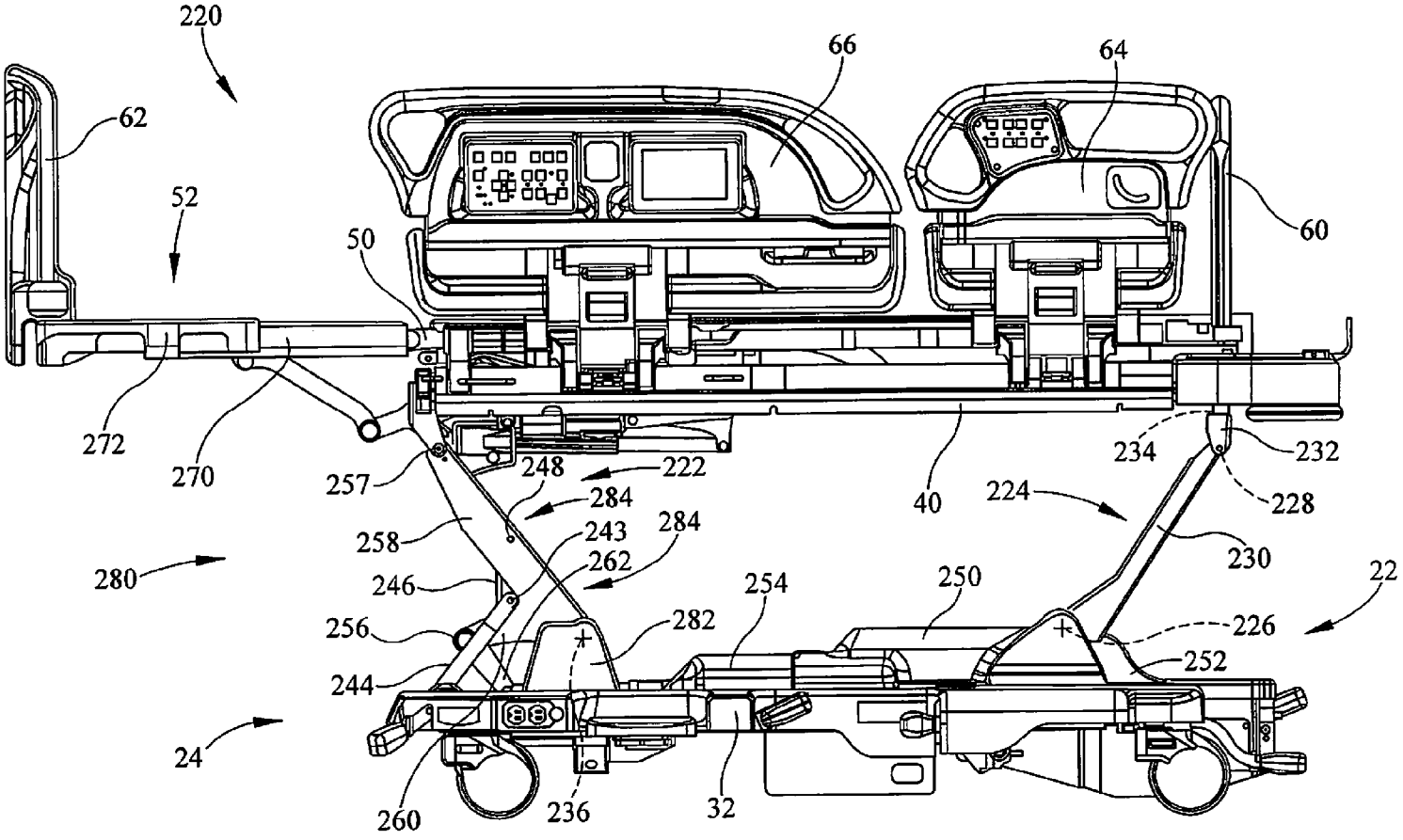
FIG. 16 is a side view of another embodiment of a bed frame assembly having head end lift mechanism that is fixed in its location relative to a base frame and a foot end lift mechanism that translates relative to the base frame.

The foot end lift mechanism 222 includes a pair of lift arms 284 that are each pivotably coupled to a carriage 282 and pivotable relative to the carriage 282 about an axis 236. The carriage 282 translates relative to the base frame 32 in a manner similar to that discussed with regard to carriage 82 above. As shown in FIG. 16, the when the foot end lift mechanism 222 is in a fully extended position, the carriage 282 is positioned in a configuration that causes the carriage 282 to be the nearest to the foot end 24 of the base frame 32 it achieves during movement of the foot end lift mechanism 222. Activation of the foot end lift mechanism 222 to lower the foot end 24 of the elevatable frame 40 causes the carriage 282 to move toward the head end 22 of the base frame 32 of the bed 20.

The foot end lift mechanism 222 also includes a pair of ground links 244 that are each pivotably coupled to the base frame 32 at pivots 245 on opposite lateral sides with each link 244 pivotably coupled to a swing link 246 at a pivot 250. The swing links 246 are each pivotably coupled to a respective lift arm 284 at a pivot 248. Referring now to FIG. 20, the foot end lift mechanism 222 further includes a pair of link arms 249 each of which is pivotably coupled to the swing links 246 at the pivot 250. The link arms 249 are coupled to the carriage 282 at pivots 251. The link arms 249 and lift arms 284 cooperate as a parallelogram mechanism with the swing link connecting the lift arms 284 and link arms 249 at an upper end and a frame 264 of the carriage 284 connecting the lift arms 284 and link arms 249 at a lower end.

The lift arms 284 are each also pivotably coupled to the elevatable frame 40 on opposite lateral sides at pivot 257. The lift arms 284 are interconnected by a torque tube 256 that is coupled to a flange 260 that extends from a body 258 of the lift arms 284. The torque tube 256 supports the lift arms 284 and is pivotable relative to the flanges 260. A pair of arms 262 are fixed to the torque tube 256. An actuator 120 is pivotably coupled to the arms 262 so that extension and retraction of actuator 120 causes rotation of the torque tube 256 relative to the lift arms 284. The actuator 120 is also pivotably coupled to the base frame 32 and causes all of the motion of the foot end lift mechanism 222 and the carriage 282 relative to the base frame 32.

In operation, the retraction of actuator 120 causes torque tube 256 to rotate and allows lift arms 284 to pivot about axis 236 while links 249 pivot about the pivot 251. The ground links 244 act on the swing links 246 to control movement of the lift arms 284 and carriage 282 to urge the carriage 282 toward the head end 22 of the base frame 32 while the actuator retracts. The head end lift mechanism 224 operates independently with a separate actuator 266 (best seen in FIG. 20) to control elevation of the head end 22 of the elevatable frame 40.

Figure 17:
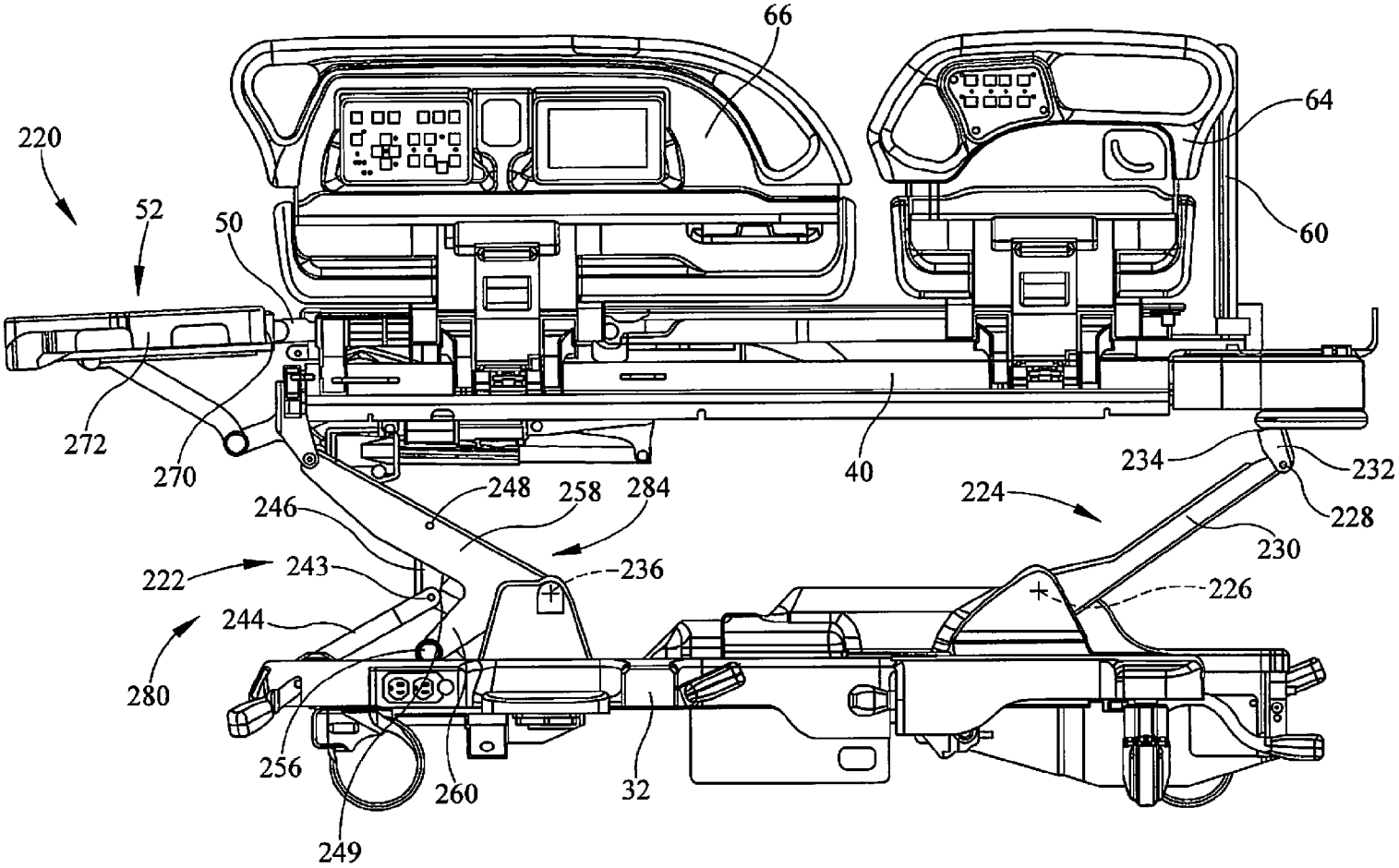
FIG. 17 is a view similar to the view of FIG. 16, the bed frame assembly having an elevatable frame lowered in FIG. 17.
Figure 18:
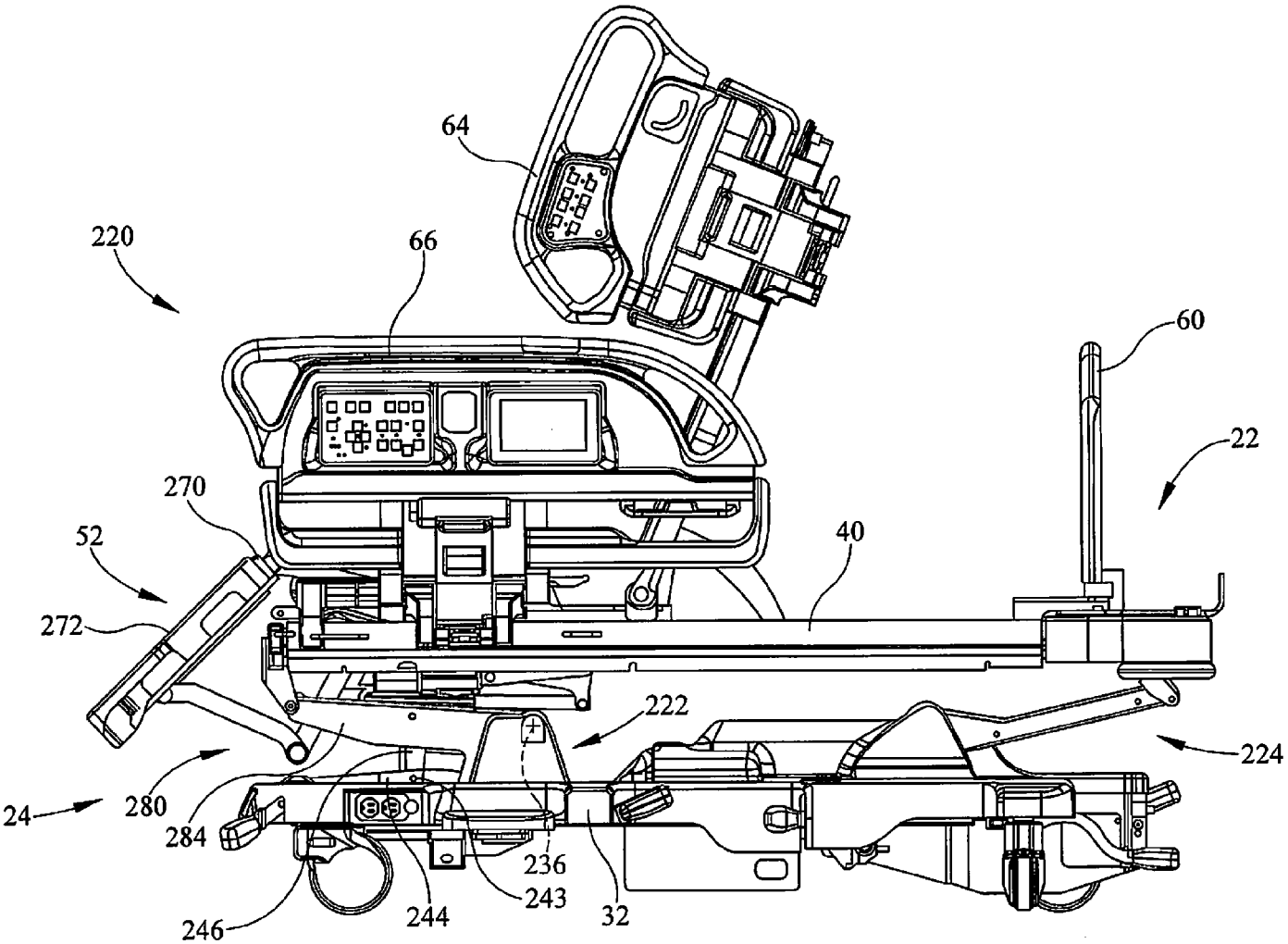
FIG. 18 is a view similar to the view of FIG. 16, the bed frame assembly having an elevatable frame lowered to a position lower than that shown in FIG. 17.
Figure 19:
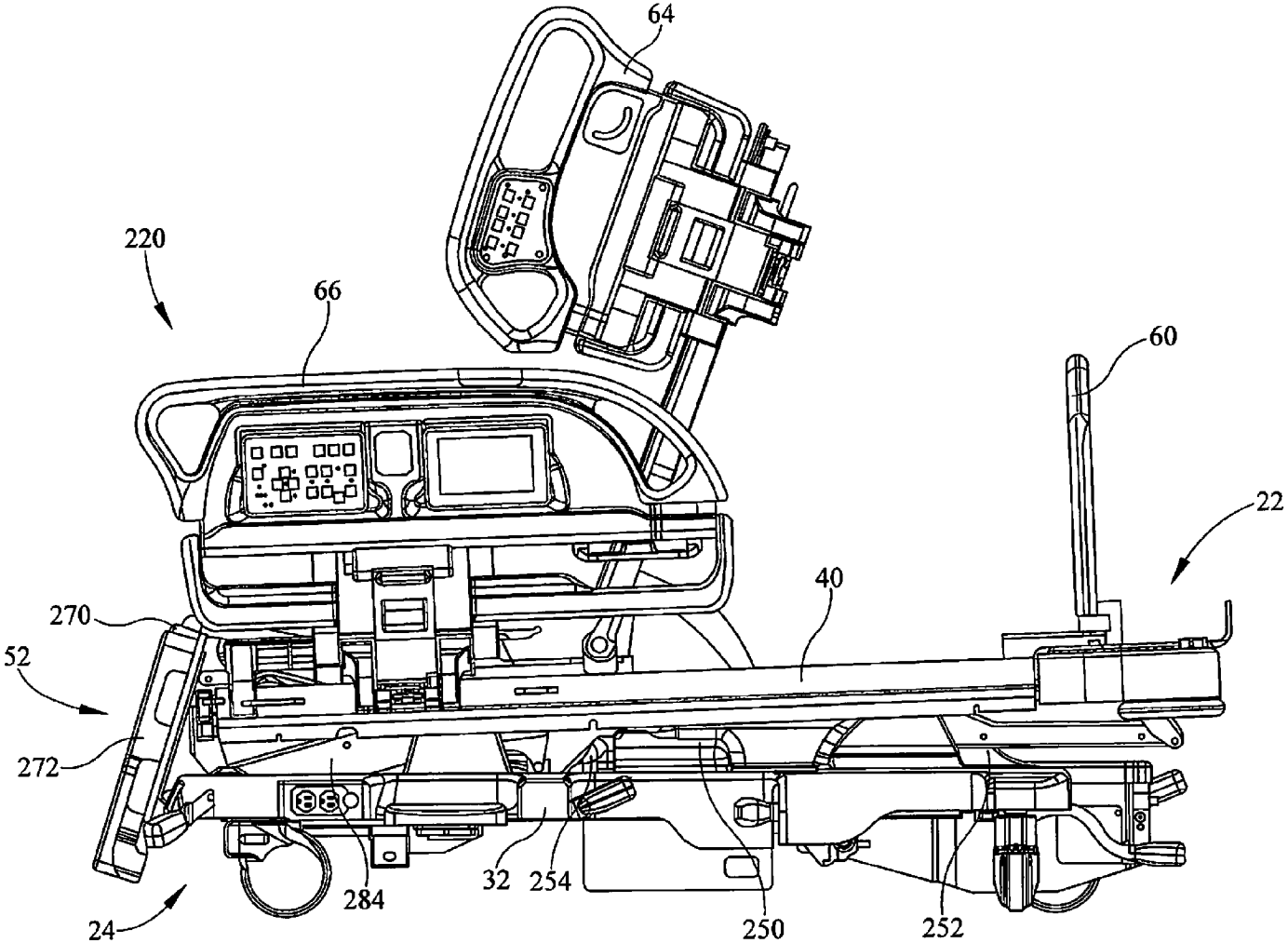
FIG. 19 is a view similar to the view of FIG. 16, the bed frame assembly having an elevatable frame lowered in FIG. 18 and a head end of the elevatable frame slightly higher than a foot end of the elevatable frame, the bed frame assembly positioned in a chair configuration.

As shown in FIGS. 16-18, the calf section 52 has a fixed portion 270 that pivots relative to the thigh section 50 and a moving portion 272 that retracts onto the fixed portion 270 to reduce the length of the calf section 52 as the bed 220 moves to a chair position, such as the position shown in FIG. 19.

In addition, the bed 220 includes three covers secured to the base frame 32 including a main cover 250, a head end cover 252, and a moving cover 254. The main cover 250 is secured to the base frame with two screws 256 and two washers 258 as suggested in FIG. 20. The head end cover 252 is coupled to the base frame 32 by a screw 256 as suggested in FIG. 20. The moving cover 254 is secured to the carriage 282 by two screws 256. The moving cover 254 moves with the carriage 282 and telescopes or collapses relative to the main cover 250 as the carriage 282 moves relative to the base frame 32.

As can be seen in the progression of FIGS. 16-19, retraction of the actuator 120 causes the lift arms 284 to rotate about axis 236, lowering the foot end 24 of the elevatable frame 40. The carriage 282 moves away from the foot end 24 toward the head end 22, causing the entire head end lift mechanism 224 to move inboard. As the deck 44 moves toward a chair configuration, the movement of the carriage 282, and thereby, the foot end lift mechanism 222 provides clearance for the calf section 52 to pivot relative to the elevatable frame 40 without any elements of the foot end lift mechanism 222 being in the way of the calf section 52. Similarly, the moving cover 254 moves relative to the main cover 250. This allows the moving cover 254 to cover certain moving parts of the foot end lift mechanism 222 while the lift system 280 operates.

As can be seen in FIG. 19, in a chair position, the head end lift mechanism 224 may lift a head end 22 of the elevatable frame 40 relative to the foot end 24 of the elevatable frame 40 to thereby improve the ability for an occupant to egress from the foot end 24 of the bed 220. In addition, the reduction in the length of the calf deck section 52 by moving the moving portion 272 relative to the fixed portion 270 allows the overall height of the bed 220 to be lower in the chair position, reducing the potential for interference with the floor.

The independent movement of the foot end lift mechanism 222 and the head end lift mechanism 224 in conjunction with the movement of the carriage 282 to reduce the distance between the axes 226 and 236 results in improved clearance and a lower height of the elevatable frame 40 than could be achieved without movement of carriage 282. In addition, the movement of carriage 282 permits the elevatable frame 40 to be lowered with the elevatable frame 40 maintaining a constant attitude relative to the floor. This configuration cooperates to improve the ability of the bed 220 to achieve an acceptable chair position, as shown in FIG. 19, than might be achieved without the cooperating elements.

Although this disclosure refers to specific embodiments, it will be understood by those skilled in the art that various changes in form and detail may be made without departing from the subject matter set forth in the accompanying claims.

The invention claimed is:

1. A patient support apparatus comprising a base frame, an elevatable upper frame that is movable vertically relative to a base frame, a lift system comprising a first lift mechanism that includes a first lift arm that is pivotable about a first axis that is fixed relative to the base frame, the first lift mechanism operable to move one end of the elevatable upper frame vertically relative to the base, and a second lift mechanism that includes a carriage that translates relative to the base frame, the carriage supporting a second lift arm that is pivotable about a second axis, second axis movable during movement of the second lift mechanism to change the distance between the first and second axes, the second lift mechanism operable to move a second end of the elevatable upper frame relative to the base independently of the first lift mechanism, the second lift mechanism including an actuator that has a first end that is pivotably coupled to the base frame a first pivot that is fixed relative to the base frame and a second end that moves relative to the base frame to cause rotation of the second lift arm relative to the carriage and movement of the carriage relative to the base frame, wherein the second lift mechanism further comprises a link arm pivotably coupled to the carriage at a second pivot, a swing link coupled to the second lift arm at a third pivot and the link arm at a fourth pivot spaced apart from the second pivot, the lift arm, link arm, and swing link cooperating to form a parallelogram linkage.

2. The patient support apparatus of claim 1, wherein the second lift mechanism further comprises a ground link coupled to the base frame at a fifth pivot and the swing link at the third pivot, the ground link acting on the swing link to control movement of the parallelogram linkage during extension and retraction of the actuator.

3. The patient support apparatus of claim 2, wherein the second lift mechanism further comprises a torque tube that is pivotable relative to the second lift arm and an arm extending from the torque tube, the arm pivotably coupled to the actuator such that extension or retraction of the actuator causes rotation of the torque tube relative to the second lift arm.

4. The patient support apparatus of claim 3, wherein the lift arm is pivotably coupled to the elevatable frame.

5. A patient support apparatus comprising a base frame, an elevatable upper frame that is movable vertically relative to a base frame, a lift system comprising a first lift mechanism that includes a first lift arm that is pivotable about a first axis that is fixed relative to the base frame, the first lift mechanism operable to move one end of the elevatable upper frame vertically relative to the base, and a second lift mechanism that includes a carriage that translates relative to the base frame, the carriage supporting a second lift arm that is pivotable about a second axis, second axis movable during movement of the second lift mechanism to change the distance between the first and second axes, the second lift mechanism operable to move a second end of the elevatable upper frame relative to the base independently of the first lift mechanism, the second lift mechanism including an actuator that has a first end that is pivotably coupled to the base frame a first pivot that is fixed relative to the base frame and a second end that moves relative to the base frame to cause rotation of the second lift arm relative to the carriage and movement of the carriage relative to the base frame, wherein the second lift mechanism further comprises swing link coupled to the lift arm at a second pivot, a ground link coupled to the base frame at a third pivot and pivotably coupled to the swing link at the second pivot, the ground link acting on the swing link to control movement of the lift arm during extension and retraction of the actuator.

6. The patient support apparatus of claim 5, wherein the swing link and lift arm are cooperating members of a parallelogram linkage.

7. A patient support apparatus comprising a base frame, an elevatable upper frame that is movable vertically relative to a base frame, a lift system comprising a first lift mechanism that includes a first lift arm that is pivotable about a first axis that is fixed relative to the base frame, the first lift mechanism operable to move one end of the elevatable upper frame vertically relative to the base, and a second lift mechanism that includes a carriage that translates relative to the base frame, the carriage supporting a second lift arm that is pivotable about a second axis, second axis movable during movement of the second lift mechanism to change the distance between the first and second axes, the second lift mechanism operable to move a second end of the elevatable upper frame relative to the base independently of the first lift mechanism, the second lift mechanism including an actuator that has a first end that is pivotably coupled to the base frame a first pivot that is fixed relative to the base frame and a second end that moves relative to the base frame to cause rotation of the second lift arm relative to the carriage and movement of the carriage relative to the base frame, wherein the second lift mechanism further comprises a torque tube that is pivotable relative to the second lift arm and an arm extending from the torque tube, the arm pivotably coupled to the actuator such that extension or retraction of the actuator causes rotation of the torque tube relative to the second lift arm, and wherein the patient support apparatus includes a fixed cover supported on the base frame and a moving cover supported on the second lift mechanism the moving cover movable with the second lift mechanism relative to the fixed cover.

8. The patient support apparatus of claim 7, wherein the moving cover translates relative to the base frame.

9. The patient support apparatus of claim 8, wherein the moving cover is secured to the carriage.

10. A patient support apparatus comprising a base frame, an elevatable upper frame that is movable vertically relative to a base frame, a lift system comprising a first lift mechanism that includes a first lift arm that is pivotable about a first axis that is fixed relative to the base frame, the first lift mechanism operable to move one end of the elevatable upper frame vertically relative to the base, and a second lift mechanism that includes a carriage that translates relative to the base frame, the carriage supporting a second lift arm that is pivotable about a second axis, second axis movable during movement of the second lift mechanism to change the distance between the first and second axes, the second lift mechanism operable to move a second end of the elevatable upper frame relative to the base independently of the first lift mechanism, the second lift mechanism including an actuator that has a first end that is pivotably coupled to the base frame a first pivot that is fixed relative to the base frame and a second end that moves relative to the base frame to cause rotation of the second lift arm relative to the carriage and movement of the carriage relative to the base frame, wherein the second axis translates in a horizontal plane to reduce the distance between the first axis and the second axis as the second end of the elevatable frame is lowered, and wherein the second lift mechanism further comprises a link arm pivotably coupled to the carriage at a second pivot, a swing link coupled to the second lift arm at a third pivot and the link arm at a fourth pivot spaced apart from the second pivot, the lift arm, link arm, and swing link cooperating to form a parallelogram linkage.

11. The patient support apparatus of claim 10, wherein the second lift mechanism further comprises a ground link coupled to the base frame at a fifth pivot and the swing link at the third pivot, the ground link acting on the swing link to control movement of the parallelogram linkage during extension and retraction of the actuator.

12. The patient support apparatus of claim 11, wherein the second lift mechanism further comprises a torque tube that is pivotable relative to the second lift arm and an arm extending from the torque tube, the arm pivotably coupled to the actuator such that extension or retraction of the actuator causes rotation of the torque tube relative to the second lift arm.

13. The patient support apparatus of claim 12, wherein the lift arm is pivotably coupled to the elevatable frame.

14. The patient support apparatus of claim 13, wherein the patient support apparatus includes a fixed cover supported on the base frame and a moving cover supported on the second lift mechanism the moving cover movable with the second lift mechanism relative to the fixed cover.

15. The patient support apparatus of claim 14, wherein the moving cover translates relative to the base frame.

16. The patient support apparatus of claim 15, wherein the moving cover is secured to the carriage.

* * * * *